US010854402B2

(12) United States Patent
Ye et al.

(10) Patent No.: US 10,854,402 B2
(45) Date of Patent: Dec. 1, 2020

(54) KNOB ASSEMBLY AND SHUTTLE STRUCTURE HAVING KNOB ASSEMBLY

(71) Applicant: PEGATRON CORPORATION, Taipei (TW)

(72) Inventors: Long-Sing Ye, Taipei (TW); Tao-Hsiang Tang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/697,343

(22) Filed: Nov. 27, 2019

(65) Prior Publication Data

US 2020/0243280 A1 Jul. 30, 2020

(30) Foreign Application Priority Data

Jan. 30, 2019 (TW) ..... 108103643 A

(51) Int. Cl.
*H01H 19/04* (2006.01)
*H01H 19/14* (2006.01)

(52) U.S. Cl.
CPC ..... *H01H 19/04* (2013.01); *H01H 19/14* (2013.01)

(58) Field of Classification Search
CPC ..... H01H 19/04; H01H 19/14; H01H 19/54; H01H 19/20; H01H 19/28; H01H 19/60; H01H 19/605; Y10T 292/082; Y10T 292/088; Y10T 292/0894; Y10T 292/0895; Y10T 292/0907; Y10T 292/42; Y10T 292/426; Y10T 292/438; Y10T 292/444; Y10T 403/7005; Y10T 403/7007; Y10T 74/2084; G05G 1/10; G05G 1/085;

(Continued)

(56) References Cited

U.S. PATENT DOCUMENTS 4,235,556 A * 11/1980 Dewey ..... B41J 19/96 400/567
4,593,430 A * 6/1986 Spangler ..... B25G 3/18 16/422

(Continued)

FOREIGN PATENT DOCUMENTS

CN 201688338 U 12/2010
CN 106340416 A 1/2017

(Continued)

*Primary Examiner* — Edwin A. Leon
*Assistant Examiner* — Lheiren Mae A Caroc
(74) *Attorney, Agent, or Firm* — McClure, Qualey & Rodack, LLP

(57) ABSTRACT

A knob assembly includes a lower housing, a pushing member, an upper housing, and a screw member. The lower housing includes a tank and hook structures. A through via is formed at the center of the lower housing. The upper housing is rotatably stacked on the lower housing. A lower surface of the upper housing includes an annular hook groove. The pushing member is disposed between the upper and the lower housing, and includes a body and pushing structures. A screw hole is formed at the center of the body. When the screw member is screwed into the screw hole through the through via, the pushing member moves toward and locks the lower housing, and the pushing structures push the hook structures to cause the hook structures to expand outward and be hooked to the annular hook groove, so that the upper housing is limited by the lower housing.

11 Claims, 5 Drawing Sheets

(58) Field of Classification Search
CPC ... G05G 1/08; G05G 1/12; G05G 1/06; B60K 37/06
USPC ..... 200/293, 303
See application file for complete search history.

(56) References Cited

U.S. PATENT DOCUMENTS 6,972,386 B1 * 12/2005 McSwiggen ..... H01H 19/005 200/11 R
2014/0165782 A1 * 6/2014 Windauer ..... F41G 3/06 74/813 L

FOREIGN PATENT DOCUMENTS

TW M257693 U 3/2005
TW M357011 U 5/2009

* cited by examiner

KNOB ASSEMBLY AND SHUTTLE STRUCTURE HAVING KNOB ASSEMBLY

CROSS-REFERENCE TO RELATED APPLICATION

This application claims the priority benefit of Taiwan application serial no. 108103643, filed on Jan. 30, 2019. The entirety of the above-mentioned patent application is hereby incorporated by reference herein and made a part of this specification.

BACKGROUND

Technical Field

The present disclosure relates to a knob assembly, and in particular, to a knob assembly in which an upper housing is limited on a lower housing through a pushing member and a shuttle structure having the knob assembly.

Related Art

With the advancement of technology, the use of shuttle structures has become increasingly common. A user can operate an electronic device or operate a function interface thereof by using a shuttle structure.

For example, in the process of using a multimedia device, the volume, image capture or selection of other functions may be controlled by operating a shuttle device. The advantage of using the shuttle structure lies in that the shuttle structure can be smoothly operated in one rotation direction or may be reversely rotated to select an opposite function, and no fault occurs in the functional state during operation.

Therefore, how to design a knob assembly and a shuttle structure which are easy to assemble and operate is a subject urgently needed to be studied by a person skilled in the art.

SUMMARY

In view of this, an embodiment of the present disclosure provides a knob assembly, including a lower housing, a pushing member, an upper housing, and a screw member.

The lower housing includes a tank and a plurality of hook structures disposed in the tank. A through hole is formed at the center of the lower housing. The upper housing is rotatably stacked on the lower housing along an axis, and includes an annular hook groove disposed on a lower surface of the upper housing. The pushing member is disposed between the upper housing and the lower housing, and includes a body and a plurality of pushing structures disposed around the body. A screw hole is formed at the center of the body. When the screw member is screwed into the screw hole through the through hole, the pushing member moves toward and locks the lower housing, and the pushing structures push the hook structures to cause the hook structures to expand outward and be hooked to the annular hook groove of the upper housing, so that the upper housing is limited on the axis by the lower housing.

In the knob assembly or shuttle structure according to one or more embodiments of the present disclosure, the upper housing and the lower housing are hooked to each other by using the pushing member, such that the knob assembly is easy to assemble and disassemble, and convenient to use.

DETAILED DESCRIPTION

Figure 1:
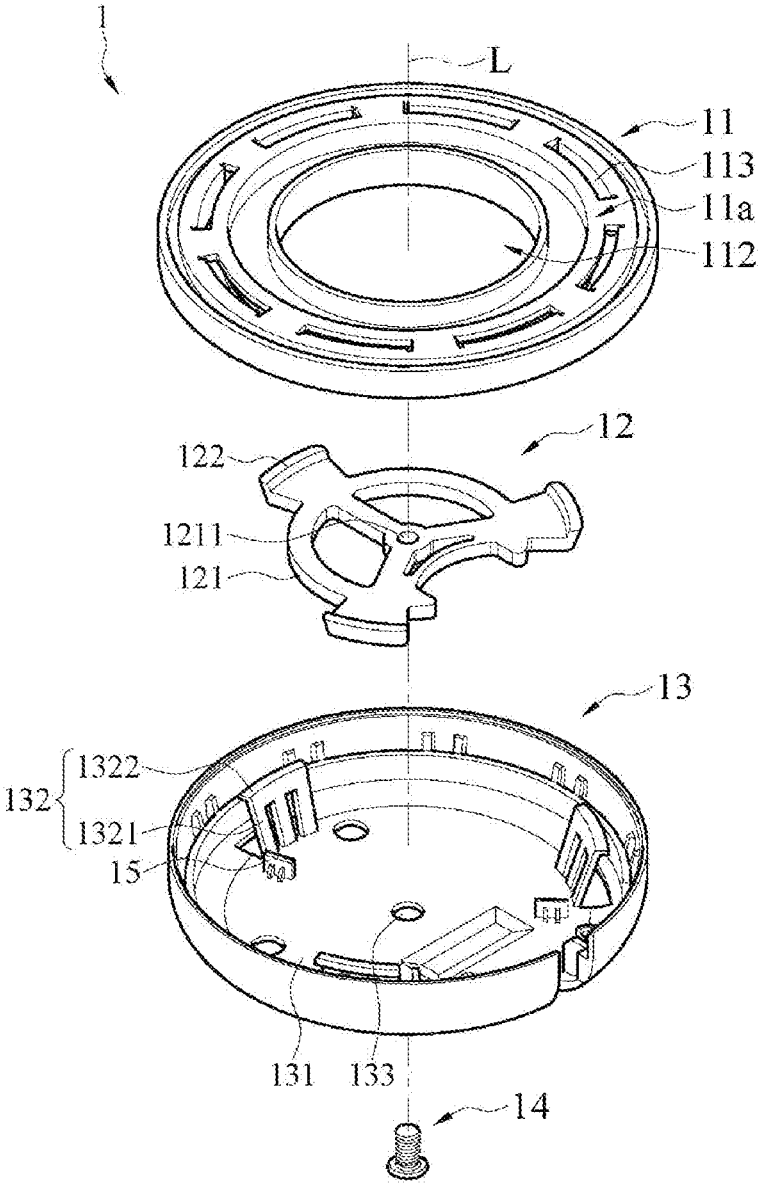
FIG. 1 is a schematic exploded view of a knob assembly according to an embodiment of the present disclosure.
Figure 2:
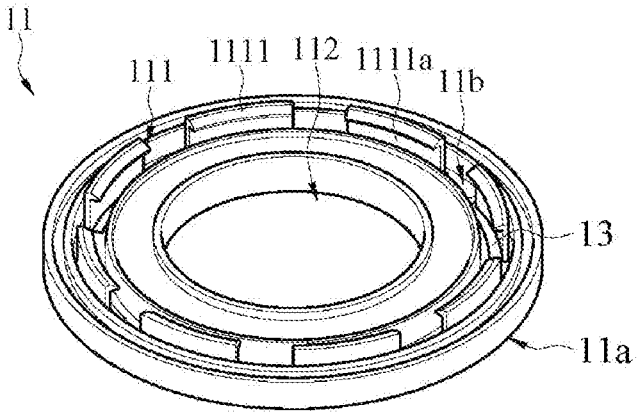
FIG. 2 is a schematic outside view of an upper housing of a knob assembly according to an embodiment of the present disclosure.

FIG. 1 is a schematic exploded view of a knob assembly 1 according to an embodiment of the present disclosure. FIG. 2 is a schematic outside view of an upper housing 11 of the knob assembly 1 according to an embodiment of the present disclosure.

As shown in FIG. 1 and FIG. 2, the knob assembly 1 includes an upper housing 11, a pushing member 12, a lower housing 13, and a screw member 14. The lower housing 13 includes a tank 31. A plurality of hook structures 132 is disposed in the tank 131. A first through via 133 is formed at the bottom center of the tank 131.

The upper housing 11 is rotatably stacked on the lower housing 13 along an axis L, and a lower surface 11*b* of the upper housing 11 includes an annular hook groove 111. In the embodiment shown in FIG. 2, the annular hook groove 111 includes a plurality of hook grooves 1111 evenly arranged around a center of the lower surface 11*b*.

The pushing member 12 is disposed between the upper housing 11 and the lower housing 13, and the pushing member 12 includes a body 121 and a plurality of pushing structures 122. A screw hole 1211 is formed at the center of the body 121. A number of the pushing structures 122 is the same as a number of the hook structures 132 of the lower housing 13. The pushing structures 122 are connected to the body 121, and the pushing structures 122 are evenly arranged around the body 121. Being evenly arranged means that the plurality of pushing structures 122 is annularly arranged at equal intervals on a circumference. In short, the pushing structures 122 are symmetrically arranged with the screw hole 1211 as a center point. In the embodiment shown in FIG. 1, there are three pushing structures 122 and three hook structures 132. In some embodiments, there may be four or more pushing structures 122, which is not limited in the present disclosure.

When a screw member 14 is screwed into the screw hole 1211 through the first through via 133, the pushing member 12 moves toward and locks the lower housing 13, and the pushing structures 122 push the hook structures 132 to cause the hook structures 132 to expand outward and be hooked to the annular hook groove 111, so that the upper housing 11 is limited along the axis L by the lower housing 13. In this way, the upper housing 11 and the lower housing 13 are combined with each other and can rotate relative to each other.

In some embodiments, the upper housing 11 is integrally formed. Compared to a disassemblable housing, the integrally formed upper housing requires fewer manufacturing procedures and low costs. Besides, the upper housing 11 has higher precision than a disassemblable housing.

In the embodiment shown in FIG. 1, each of the hook structures 132 includes a limiting portion 1321 and a clamping portion 1322. The limiting portion 1321 is connected to the bottom of the tank 131 and extends toward an outer edge of the tank 131. An inclination angle $\alpha$ exists between the limiting portion 1321 and the bottom of the tank 131. The clamping portion 1322 is connected to the limiting portion 1321 and hooked to the annular hook groove 111.

Figure 5:
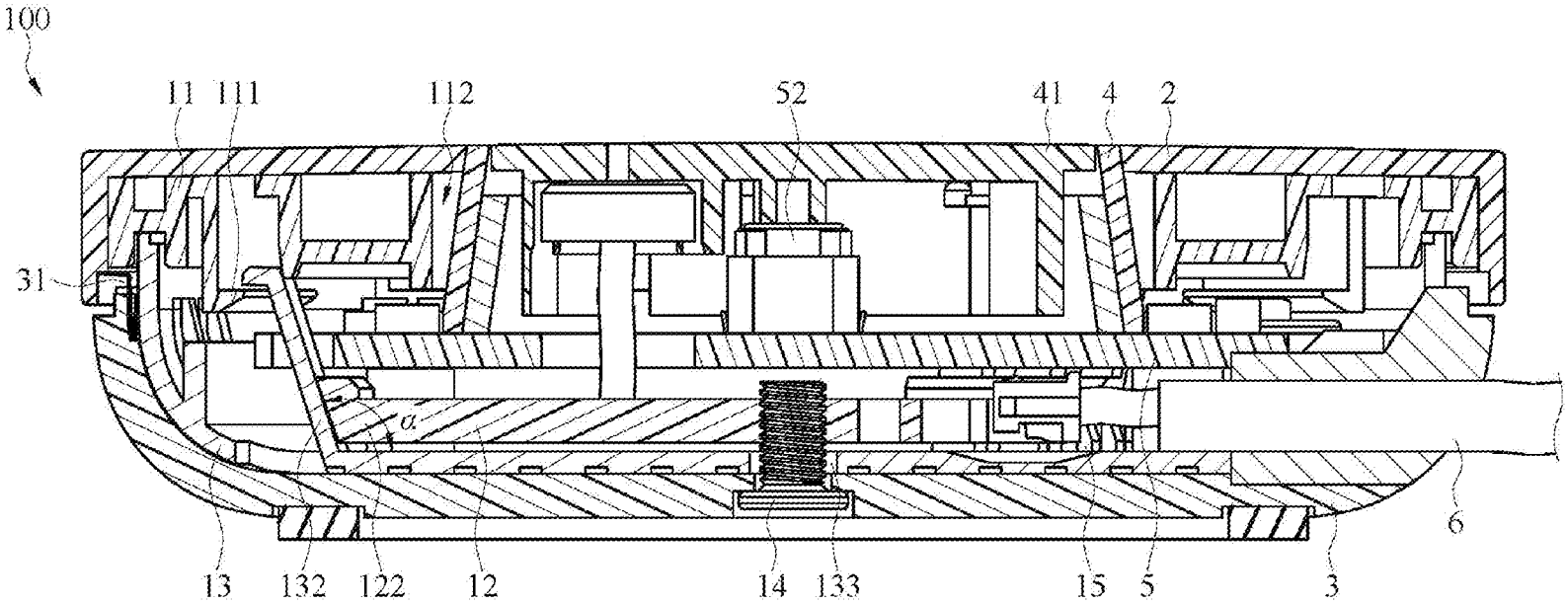
FIG. 5 is a schematic cross-sectional view of a shuttle structure according to an embodiment of the present disclosure.

The inclination angle α is an angle between the limiting portion 1321 and the bottom of the tank 131, as shown in FIG. 5. In the embodiments shown in FIG. 1 and FIG. 5, the inclination angle α is an obtuse angle. In an embodiment, when the pushing structures 122 push the hook structures 132 to cause the hook structures 132 to expand outward and be hooked to the annular hook groove 111 of the upper housing 11, a change in the inclination angle α ranges from 1 to 10 degrees.

Referring to FIG. 1, in this embodiment, the knob assembly 1 further includes a stopper plate 15, disposed on one side of each hook structure 132 of the lower housing 13. The stopper plate 15 is configured to prevent the pushing member 12 from rotating along the axis L during screwing the screw member 14 into the screw hole 1211, to ensure that the screw member 144 can be screwed into the pushing member 12.

Referring to FIG. 2, in the embodiment shown in FIG. 2, each hook groove 1111 of the upper housing 11 includes an opening 1111*a*, and the opening 1111*a* faces toward the center of the lower surface 11*b* and is clamped to the hook structure 132. In some embodiments, the opening 1111*a* of the hook groove 1111 faces away from the center of the surface 11*b*. That is to say, the orientation of the opening 1111*a* of the hook groove 1111 is not limited in the present disclosure, and varies with different designs corresponding to the hook structure 132.

In addition, as shown in FIG. 1, curved through holes 113 corresponding to the hook grooves 1111 are formed on an upper surface 11*a* of the upper housing 11. The configuration of the curved through holes 113 is conductive to injection molding especially when the upper housing 11 is integrally formed, can reduce the weight of the upper housing 11, and makes it easy for the user to operate the knob assembly 1. In some embodiments, the curved through holes 113 may be used for wiring of an internal electronic element.

In the embodiments shown in FIG. 1 and FIG. 2, the upper housing 11 includes a hole 112 penetrating the upper surface 11*a* and the lower surface 11*b* and located within a range surrounded by the annular hook groove 111. A button or a display interface may be disposed at the hole 112, depending on a shuttle structure 100 to which the knob assembly 1 is applied. For details, reference is made to the following description of the shuttle structure 100.

Figure 3:
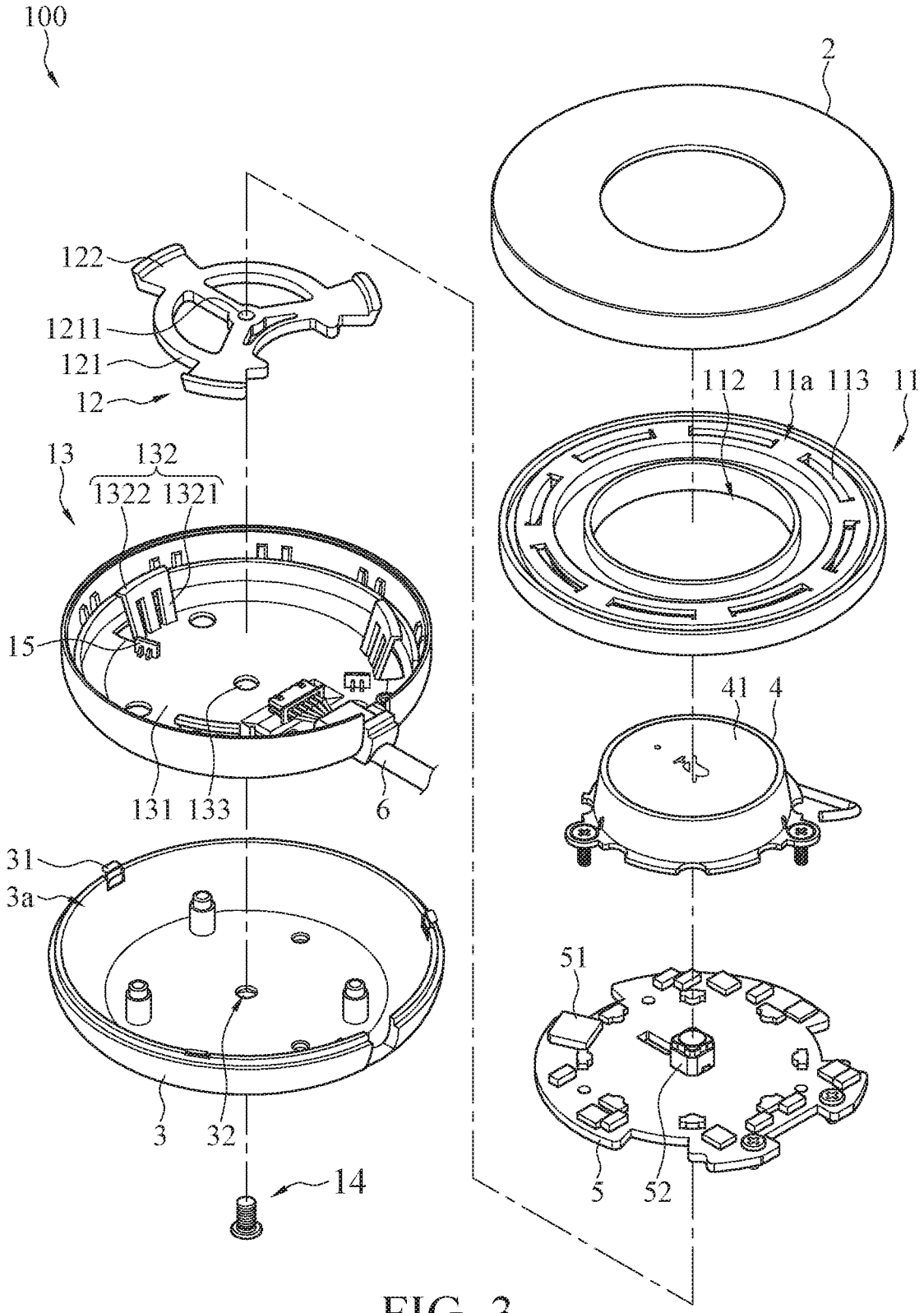
FIG. 3 is a schematic exploded view of a shuttle structure according to an embodiment of the present disclosure.
Figure 4:
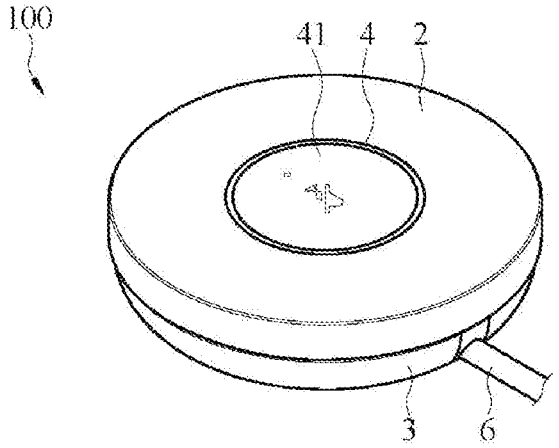
FIG. 4 is a schematic outside view of a shuttle structure according to an embodiment of the present disclosure.

Refer to FIG. 3 and FIG. 5. FIG. 3 is a schematic exploded view of a shuttle structure 100 according to an embodiment of the present disclosure. FIG. 4 is a schematic outside view of a shuttle structure 100 according to an embodiment of the present disclosure. FIG. 5 is a schematic cross-sectional view of the shuttle structure 100 according to an embodiment of the present disclosure.

The shuttle structure 100 includes a knob assembly 1, and further includes an upper cover 2, a lower cover 3, and a metal sheet 31. The upper cover 2 is made of a metal material and disposed on one side of the upper housing 11 opposite to the pushing member 12. The lower cover 3 is also made of a metal material and disposed on one side of the upper housing 13 opposite to the pushing member 122, and the lower cover 3 comprising a second through via 32. The metal sheet 31 is made of an elastic material and disposed on an inner wall 3*a* of the lower housing 13. The metal sheet 31 is configured to connect the upper cover 2 and the lower cover 3, so that the upper cover 2 and the lower cover 3 can be tightly combined and grounded, as shown in FIG. 5.

In addition, in the embodiments shown in FIG. 3 to FIG. 5, the shuttle structure 100 further includes a button module 4, a wire module 6, and a circuit board 5. A button in the button module 4 includes a display interface 41, and the button module 4 is electrically connected to the circuit board 5. The circuit board 5 is disposed between the pushing member 122 and the upper housing 11. Specifically, the circuit board 5 is disposed between the pushing member 122 and the button module 4.

A sensor 51 and a processor 52 are disposed on the circuit board 5. The sensor 51 can sense a rotation state of the upper housing 11. In an embodiment, the sensor 51 is an optical sensor, disposed on one side of the circuit board 5, and facing toward the lower surface 11*b* of the upper housing 11. In some other embodiments, the sensor 51 may be any sensing device capable of determining the rotation state of the upper housing 11.

In some embodiments, a feature pattern is disposed on the lower surface 11*b* of the upper housing 11. The optical sensor 51 is configured to sense the feature pattern, capture an image of the annular upper housing 11 in rotation, and transfer image signal to the processor 52 on the circuit board 5, so that the processor 52 performs precise calculation and analysis, and obtains the state of shuttle structure 100 operated by the user. For example, if determining that the user rotates the shuttle structure 100 clockwise (that is, the rotation state is clockwise), the processor 52 generates a volume-up signal; if determining that the user rotates the shuttle structure 100 counterclockwise (that is, the rotation state is counterclockwise), the processor 52 generates a volume-down signal.

The shuttle structure 100 provided in the present disclosure may be applied to many fields. In an embodiment, the shuttle structure 100 may be applied to a household appliance as an assistant tool for selecting a function option. In another embodiment, the shuttle structure 100 may be applied to a multimedia device such as an intelligent speaker, as an assistant tool for selecting a function option or adjusting the channel or the volume. In still another embodiment, the shuttle structure 100 may be applied to an automobile as an assistant tool for changing gears during driving. That is to say, the application of the shuttle structure 100 has been extended to more fields, which are not limited in the present disclosure.

Compared to the prior arts, components of a conventional disassemblable knob assembly have low precision in size, are easily deformed after molding to cause skewing of internal components and affect the assembly process, and are also easily deformed during subsequent operation. The knob assembly or the shuttle structure according to one or more embodiments of the present disclosure requires fewer components, is easy to manufacture, and has high precision, thereby reducing the risk of poor appearance due to assembly tolerances.

In addition, in some conventional technologies, the upper housing and the lower housing are locked using a screw, and the structure is susceptible to torsion. When there is great torsion, the structure of the knob assembly is easily deformed, affecting the rotation operation of the user. In the knob assembly or the shuttle structure according to one or more embodiments of the present disclosure, the upper housing and the lower housing are hooked to each other by using the annular pushing member, such that the knob assembly is easy to assemble and disassemble, and convenient to use.

What is claimed is:

1. A knob assembly, comprising:

a lower housing, comprising a tank and a plurality of hook structures disposed in the tank, wherein a first through via is formed at a center of the lower housing;

an upper housing, rotatably stacked on the lower housing along an axis, wherein a lower surface of the upper housing comprises an annular hook groove;

a pushing member, disposed between the upper housing and the lower housing, and comprising a body and a plurality of pushing structures disposed around the body, wherein a screw hole is formed at a center of the body; and a screw member, wherein when the screw member is screwed into the screw hole through the first through via, the pushing member moves toward and is fixed to the lower housing, and the pushing structures push the hook structures to cause the hook structures to expand outward and be hooked to the annular hook groove of the upper housing, so that the upper housing is limited on the axis by the lower housing.

2. The knob assembly according to claim 1, wherein the number of the pushing structures is the same as the number of the hook structures of the lower housing.

3. The knob assembly according to claim 1, wherein the upper housing is integrally formed.

4. The knob assembly according to claim 1, wherein the annular hook groove comprises a plurality of hook grooves evenly arranged around the center of the lower surface.

5. The knob assembly according to claim 1, wherein each of the hook structures comprises a limiting portion and a clamping portion, the limiting portion is connected to a bottom of the tank and extends toward an outer edge of the tank, an inclination angle exists between the limiting portion and the bottom of the tank, and the clamping portion is connected to the limiting portion and hooked to the annular hook groove.

6. The knob assembly according to claim 5, wherein when the pushing structures push the hook structures to cause the hook structures to expand outward and be hooked to the annular hook groove of the upper housing, a change in the inclination angle ranges from 1 to 10 degrees.

7. The knob assembly according to claim 1, further comprising a stopper plate, disposed on one side of each of the hook structures of the lower housing, wherein the stopper plate is configured to prevent the pushing member from rotating along the axis during screwing the screw member into the screw hole.

8. A shuttle structure, comprising:

a lower housing, comprising a tank and a plurality of hook structures disposed in the tank, wherein a first through via is formed at a center of the lower housing;

an upper housing, rotatably stacked on the lower housing along an axis, wherein a lower surface of the upper housing comprises an annular hook groove;

a pushing member, disposed between the upper housing and the lower housing, and comprising a body and a plurality of pushing structures disposed around the body, wherein a screw hole is formed at a center of the body; and an upper cover, made of a metal material and fixedly disposed on one side of the upper housing opposite to the pushing member;

a lower cover, made of a metal material and disposed on one side of the lower housing opposite to the pushing member, the lower cover comprising a second through via;

a screw member, wherein when the screw member is screwed into the screw hole through the second through via and the first through via, the pushing member moves toward and is fixed to the lower housing, and the pushing structures push the hook structures to cause the hook structures to expand outward and be hooked to the annular hook groove of the upper housing, so that the upper housing is limited on the axis by the lower housing; and at least one metal sheet, disposed on an inner wall of the lower cover and configured to connect the upper cover and the lower cover.

9. The shuttle structure according to claim 8, further comprising a circuit board, disposed between the pushing member and the upper housing.

10. The shuttle structure according to claim 9, further comprising a sensor, disposed on the circuit board, and configured to sense a rotation state of the upper housing.

11. The shuttle structure according to claim 10, wherein the sensor is an optical sensor.

* * * * *